US006128864A

United States Patent [19]

Barry et al.

[11] Patent Number: 6,128,864

[45] Date of Patent: Oct. 10, 2000

[54] ELLIPTICAL ARCH

[76] Inventors: Michael A. Barry, 1227 E. Ash Ave., Fullerton, Calif. 92631; George E. Goodwin, 1551 S. Highland, Apt. P., Fullerton, Calif. 92632

[21] Appl. No.: 09/391,030

[22] Filed: Sep. 7, 1999

[51] Int. Cl.[7] ..... E04B 1/32

[52] U.S. Cl. ..... 52/86

[58] Field of Search ..... 52/86, 88, 245, 52/329

[56] References Cited

U.S. PATENT DOCUMENTS

| | | | |
|---|---|---|---|
| 323,110 | 7/1885 | Carlewitz . | |
| 468,354 | 2/1892 | Mayhew . | |
| 604,277 | 5/1898 | Tofft . | |
| 1,060,918 | 5/1913 | Luten | 52/88 |
| 1,096,944 | 5/1914 | Phillips . | |
| 1,233,266 | 4/1917 | Dyer . | |
| 1,267,084 | 5/1918 | Know . | |
| 1,762,363 | 6/1930 | Sergent . | |
| 1,938,024 | 12/1933 | Keeffe . | |
| 2,011,796 | 8/1935 | Christensen . | |
| 2,292,078 | 8/1942 | Inman . | |
| 2,335,708 | 11/1943 | Strobel . | |
| 2,342,916 | 2/1944 | Blaski . | |
| 2,705,929 | 4/1955 | Atkins | 52/88 |
| 2,736,397 | 2/1956 | Colby . | |
| 2,988,810 | 6/1961 | Wilken . | |
| 3,009,211 | 11/1961 | Hansen . | |
| 3,034,824 | 5/1962 | Schubach . | |
| 3,130,488 | 4/1964 | Lindstrom . | |
| 3,164,928 | 1/1965 | Sarros | 52/88 |
| 3,168,815 | 2/1965 | Blenkle . | |
| 3,364,634 | 1/1968 | Allaire . | |
| 3,440,790 | 4/1969 | Nerem . | |
| 3,508,370 | 4/1970 | Riblet . | |
| 3,546,826 | 12/1970 | Chapman . | |
| 3,763,618 | 10/1973 | Bennett . | |
| 3,924,367 | 12/1975 | Stewart . | |
| 4,094,110 | 6/1978 | Dickens . | |
| 4,241,555 | 12/1980 | Dickens . | |
| 4,284,447 | 8/1981 | Dickens . | |
| 4,301,632 | 11/1981 | Wagner . | |
| 4,601,138 | 7/1986 | Hampton . | |
| 4,642,955 | 2/1987 | Webb . | |
| 4,665,666 | 5/1987 | Hampton . | |
| 4,780,998 | 11/1988 | Knapp . | |
| 4,785,605 | 11/1988 | Jenn . | |
| 4,873,796 | 10/1989 | Akmese . | |
| 4,955,168 | 9/1990 | Barry . | |
| 5,067,288 | 11/1991 | Takahama . | |
| 5,130,915 | 7/1992 | Lerch . | |
| 5,341,610 | 8/1994 | Moss . | |
| 5,459,974 | 10/1995 | Barry . | |
| 5,584,148 | 12/1996 | Barry . | |
| 5,649,393 | 7/1997 | Barry . | |
| 5,815,990 | 10/1998 | Barry . | |

FOREIGN PATENT DOCUMENTS

| | | |
|---|---|---|
| 533433 | 12/1954 | Belgium . |
| 1489329 | 4/1967 | France . |
| 535641 | 11/1955 | Italy . |
| 20684 | of 1906 | United Kingdom . |
| 540881 | 11/1941 | United Kingdom . |
| 1059397 | 6/1964 | United Kingdom . |

*Primary Examiner*—Jerry Redman

*Attorney, Agent, or Firm*—Stetina Brunda Garred & Brucker

[57] ABSTRACT

An arch for a ceiling structure having a first vertical wall stud and a second vertical wall stud. The arch includes an arcuate center section having opposed ends and an arcuate under surface with a first radius of curvature. The arcuate center section is sized and configured such that the opposed ends thereof abut respective ones of the first and second wall studs. The arch further includes a first and second arcuate side section attached to the center section and respective ones of the first and second vertical wall studs. Each of the first and second side sections has an arcuate under surface with a second radius of curvature less than the first radius of curvature. Accordingly, the first and second side sections create a continuous transition between the under surface of the arcuate center section and respective ones of the first and second vertical wall studs.

22 Claims, 3 Drawing Sheets

ELLIPTICAL ARCH

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to building construction and more particularly to a device for forming a dual radius arch within a doorway, window opening, wall or other type of structure.

The fabrication of elliptical or dual radius arches in residential or commercial structures usually requires considerable skill and labor. Typically, dual radius arches have a center portion with a first radius of curvature that transitions into two adjacent side portions with smaller radii of curvature. The dual radius arch is typically used in openings such as doorways or windows for decorative purposes. The center portion of the arch defines the top of the opening and the side portions transition the arch into the sides of the opening.

Prior art methods of fabricating dual radius arches typically begin by framing the arch with two-by-fours. Specifically, the arch is built between two opposed rows of vertical wall studs and below a series of headers attached to and extending therebetween. Framing is nailed to the top headers and the opposed rows of vertical wall studs in the outline of the arch to be built. In this regard, the two-by-fours form a support structure having the general shape of the arch to be built. A series of longitudinal two-by-fours (stringers) are nailed to the outline of the arch formed by the framing. A covering, such as a layer of masonite, is nailed to the longitudinal two-by-fours. The masonite is scored to bend such into the proper shape of the arch. Typically, more than one section of masonite may be used to cover the arch such that the ends of the multiple sections of masonite must be abutted together when nailed to the stringers. Once the masonite has been nailed to the longitudinal stringers, a layer of wetted drywall is screwed thereto. The wetted drywall is bent into the shape of the arch and provides a smooth finish surface thereover.

As is evidenced by the above description, the process of forming the arch is difficult and time consuming. In order to form a substantially uniform arch upon which the covering material can be applied, the framing and stringers must be perfectly aligned. Often times, the alignment of the framing and stringers is difficult and an uneven or nonuniform surface is thereby formed. Additionally, the masonite may be difficult to bend such that a smooth transition from the radius of curvature of the center portion to the radius of curvature of the side portions is difficult to form.

The present invention addresses the above-mentioned deficiencies in the construction of dual radius arches by providing a system whereby construction of such arches consistently provides a uniform support surface for the application of drywall. Additionally, the arch of the present invention is easily installed into a building without the requirement of having to build a specialized frame for support.

BRIEF SUMMARY OF THE INVENTION

In accordance with a preferred embodiment of the present invention, there is provided an arch for a ceiling structure having a first vertical wall stud and an opposed second vertical wall stud. The arch comprises a center section having opposed ends and an arcuate under surface with a first radius of curvature. The center section is sized and configured such that the opposed ends thereof abut respective ones of the first and second vertical wall studs. The arch further comprises a first and second arcuate side section. Each of the side sections is attached to respective ones of the vertical wall studs and the center section. Additionally, each of the side sections has an arcuate under surface with a second radius of curvature less than the first radius of curvature. Accordingly, the first and second side sections create a continuous transition between the under surface of the center section and respective ones of the first and second vertical wall studs.

The ceiling structure may further include a horizontal header extending between the first and second vertical wall studs. As such, the arcuate center section will have an arcuate upper surface that abuts the horizontal header when the opposed ends thereof abut respective ones of the vertical wall studs. As will be recognized to those of ordinary skill in the art, the ceiling structure may comprise a pair of first and second vertical wall studs supporting a respective pair of horizontal headers. In this respect, the center section is attached to the pairs of horizontal headers and the pairs of vertical wall studs and the first and second side sections are attached to respective pairs of the vertical wall studs. In the preferred embodiment of the present invention, the radius of curvature for the center section is approximately equal to the length of the horizontal header, while the radius of curvature for the first and second side sections is in the range of from about six inches to twelve inches.

Typically, the center section and the side sections are formed from a plurality of laminated wooden members. Alternatively, the center and side sections may be formed from bonded particulate matter selected from either cellulose fiber, shredded fiber, wooden particles, saw dust or possible combinations thereof. Further, the center and side sections may be formed from a plastic material. The under surfaces of the center, first and second side sections collectively define an arcuate support surface upon which a layer of finishing material, such as wetted drywall, may be applied.

In accordance with the present invention, there is additionally provided a method of installing an arch between a first and second pair of vertical wall studs. The method comprises positioning the center section of the arch between respective ones of the first and second wall studs. Next, the first side section is attached against the first pair of vertical wall studs and the second side section is attached against the second pair of vertical wall studs. It will be recognized that the ceiling structure may include a pair of horizontal headers extending between respective ones of the first and second pairs of vertical wall studs. In this instance, the center section will be attached to the pair of horizontal headers as well as the pairs of vertical wall studs.

BRIEF DESCRIPTION OF THE DRAWINGS

These as well as other features of the present invention, will become more apparent upon reference to the drawings wherein.

DETAILED DESCRIPTION OF THE INVENTION

Figure 1:
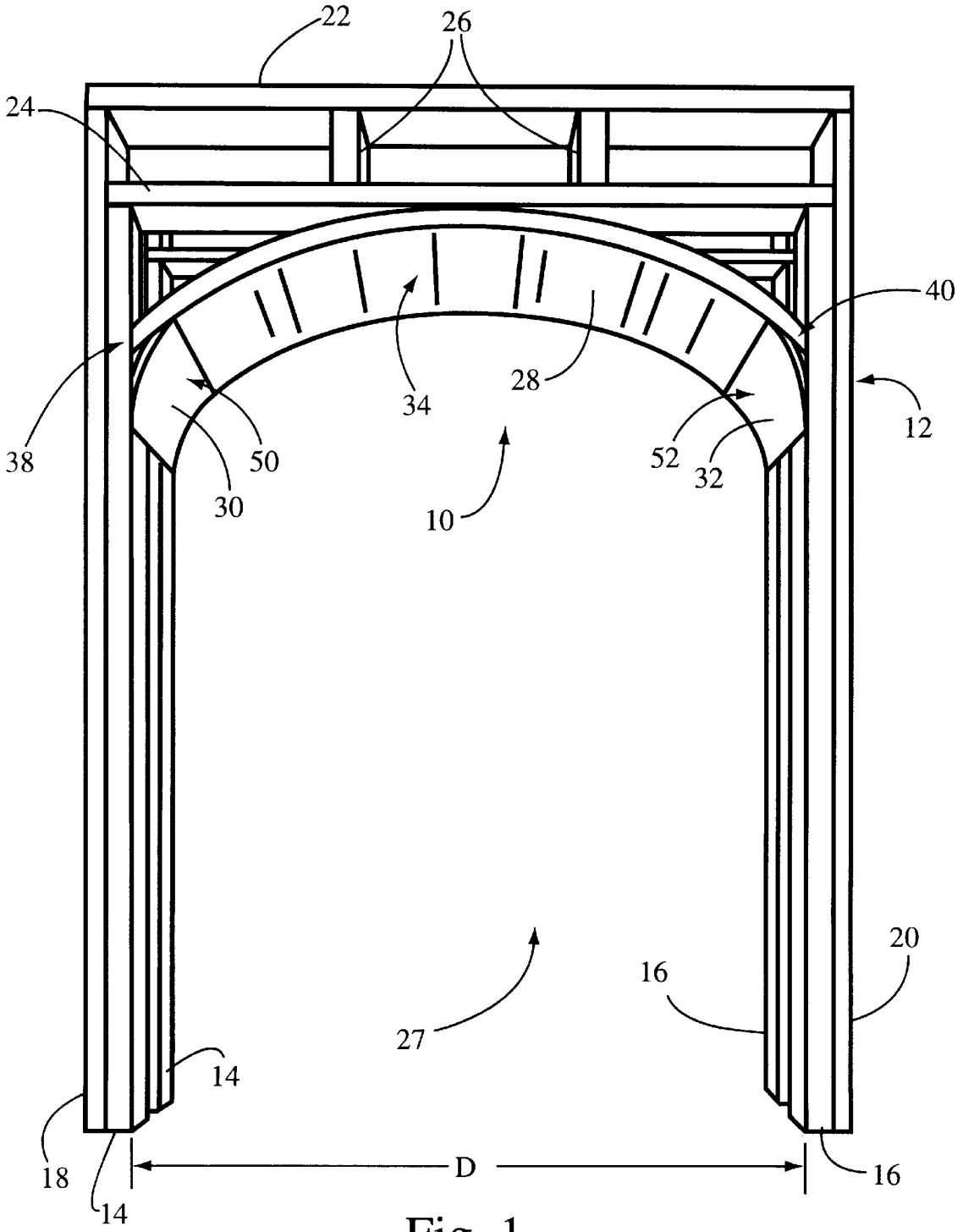
FIG. 1 perspectivley illustrates an elliptical arch of the present invention installed within a building structure.

Referring now to the drawings wherein the showings are for purposes of illustrating a preferred embodiment of the present invention only, and not for purposes of limiting the same, FIG. 1 perspectively illustrates an elliptical or dual radius arch 10 installed within the framework 12 of an opening (e.g., a doorway) for a commercial building or house. The framework 12 comprises an inner first row and an inner second row of opposed vertical wall studs 14, 16 spaced apart from one another by a distance D. Attached in laminar juxtaposition to respective ones of the inner wall studs 14, 16, are an outer first row and an outer second row of vertical wall studs 18, 20. As seen in FIG. 1, the outer rows of wall studs 18, 20 are slightly longer than the inner rows of wall studs 14, 16. In this regard, the top ends of at least one pair of the outer wall studs 18, 20 protrude upwardly beyond the top ends of the inner wall studs 14, 16 and are attached to a horizontal joist member 22 which typically supports the ceiling of the structure. The joist member 22 extends between and is supported by the top ends of the outer wall studs 18, 20. The inner wall studs 14, 16 of the corresponding pair support a horizontal header member 24 extending therebetween. The header member 24 is attached to the top ends of the inner wall studs 14, 16 and is sized to span the distance D therebetween. As seen in FIG. 1, the header member 24 extends in spaced parallel relation to the joist member 22 because, as previously mentioned, the inner wall studs 14, 16 are shorter than the outer wall studs 18, 20. Attached between the joist member 22 and the header member 24 are a series of vertical spacer blocks 26. The framework 12 therefore defines a rectangular opening 27 such as a doorway or window opening formed within a wall. Preferably, the inner wall studs 14, 16 and the outer wall studs 18, 20 are fabricated from wood (i.e. two-by-fours) and attached to respective ones of the wooden joist member 22 and header member 24 with nails.

Figure 2:
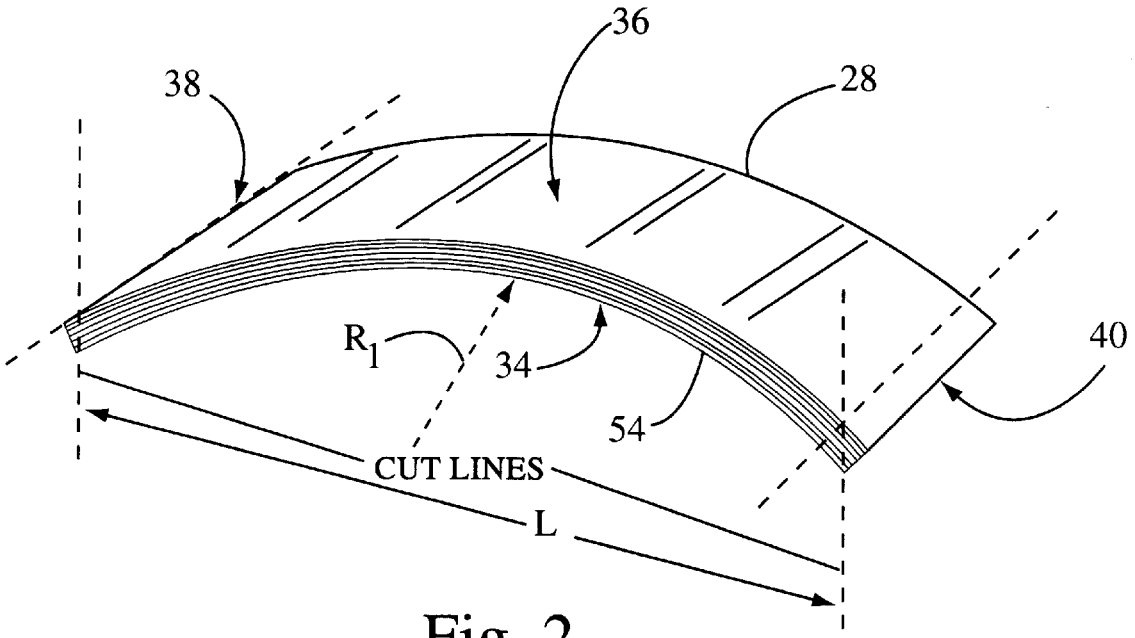
FIG. 2. perspectively illustrates a center section for the arch shown in FIG. 1.

As seen in FIG. 1, the arch 10 constructed in accordance with the preferred embodiment of the present invention comprises a center section 28 attached to first and second side sections 30, 32. Referring to FIG. 2, the center section 28 is generally arcuate and defines an opposed pair of longitudinal edges and an opposed pair of lateral edges which define respective ones of the first and second ends 38, 40 of the center section 28. In addition to the first and second ends 38, 40, the center section 28 includes an arcuate bottom surface 34 and an arcuate top surface 36. The center section 28 has a preferred radius of curvature $R_1$ that is approximately equal to the distance D between the first and second inner wall studs 14, 16 while a length L of the center section 28 is sized to span the distance D therebetween. In this respect, the center section 28 has a length L that is approximately equal to the distance D. It will be recognized to those of ordinary skill in the art, that the center section 28 may have a radius of curvature $R_1$ that is not equal to the distance D between the first and second inner wall studs 14, 16.

As seen in FIG. 1, the first end 38 of the center section 28 is in abutting contact with the inner first row of wall studs 14, with the second end 40 being in abutting contact with the inner second row of wall studs 16. The first and second ends 38, 40 of the center section 28 extend along respective ones of the inner rows of wall studs 14, 16, as seen in FIG. 2. Accordingly, the center section 28 can be secured in place by toe nailing such to the inner rows of wall studs 14, 16. As will be recognized by those of ordinary skill in the art, the center section 28 can also be secured to the inner rows of wall studs 14, 16 with screws and/or brackets.

The center section 28 is also secured to the horizontal header member 24. As seen in FIG. 1, the apex (or topmost part of the curve) of the center section 28 is in abutting contact with a bottom side of the horizontal header member 24. Accordingly, nails and/or screws can be driven through the bottom surface 34 of the center section 28 into the bottom side of the horizontal header member 24.

As previously described above, the arch 10 includes a first and a second identically configured side section 30, 32 that are attached to the center section 28. Similar to the center section 28, the first and second side sections 30, 32 are each arcuately contoured and include opposed, generally parallel pairs of longitudinal and lateral edges. Additionally, the first and second side sections 30, 32, each have a radius of curvature $R_2$ along a respective bottom surface 50, 52 thereof. In the preferred embodiment of the present invention, the radius of curvature $R_2$ for each side section 30, 32 is less than the radius of curvature $R_1$ for the center section 28. Typically, the radius of curvature $R_2$ is in the range from between about six inches to about twelve inches. Accordingly, the first and second side sections 30, 32 are more rounded or curved than the center section 28. The first and second side sections typically have a thickness of about ½ inch thereby allowing the side sections 30, 32 to be curved and reduce the amount of back-planing necessary during fabrication thereof.

Each of the side sections 30, 32 are configured to be in abutting contact with respective ones of the inner wall studs 14, 16 and a respective end 38, 40 of the center section 28. In this regard, the first side section 30 is attached to the inner first row of wall studs 14 and the center section 28 proximate to the first end 38 thereof. Specifically, an upper surface of the first side section 30 is in abutting contact with the bottom surface 34 of the center section 28 and the inner first row of wall studs 14. The second side section 32 is similarly attached to the inner second row of vertical wall studs 16 and the center section 28 proximate the second end 40 thereof.

Figure 3:
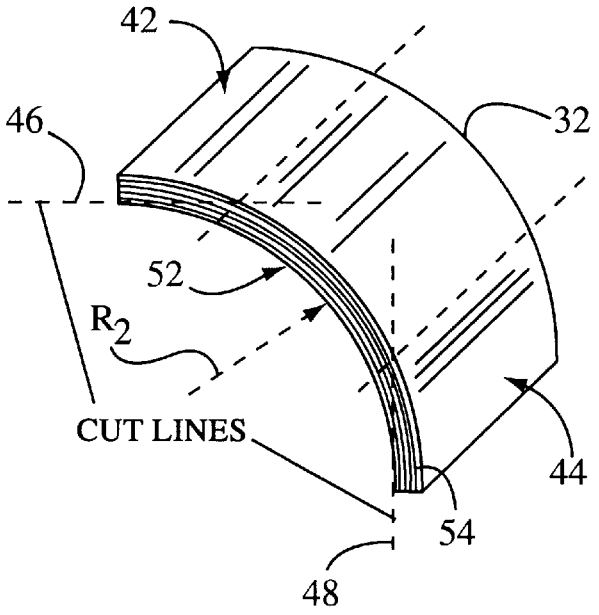
FIG. 3 perspectively illustrates one of the side sections for the arch shown in FIG. 1.

In order to form the dual radius arch 10, each side section 30, 32 is configured to transition the radius of curvature $R_1$ of the center section 28 into the radius of curvature $R_2$ of each side section 30, 32. Specifically, each side section 30, 32 is cut with a taper at both ends thereof. Referring to FIG. 3, the second side section 32 is cut along respective first and second cut lines 46, 48 to form tapered end portions 42, 44. The end portions 42, 44 are cut and tapered in order for the bottom surface 52 of the second side section 32 to be substantially flush with the bottom surface 34 of the center section 28 and the second row of inner wall studs 16 when attached thereto. The cut lines 46, 48 are therefore angled on the second side section 32 to achieve a substantially flush transition between the center section 28 and the second row of inner wall studs 16. Typically, the first cut line 46 is angled along the top end portion 42 of the second side section 32 such that the top surface of the top end portion 42 is substantially parallel to the bottom surface 34 of the center section 28 when attached thereto. Similarly, the second cut line 48 is angled along the bottom end portion 44 of the second side section 32 such that the top surface of the bottom end portion 44 of the second side section 32 is substantially parallel to the inner second row of wall studs 16 when attached thereto. Accordingly, when the second side section 32 is attached to the center section 28 and the second row of inner wall studs 16, the second side section 32 is substantially flush therewith.

In accordance with the preferred embodiment of the present invention, the first side section 30 is configured complementary to the second side section 32. As will be recognized by those of ordinary skill in the art, the top and bottom ends of the first side section 30 will be cut such that the top and bottom end portions thereof are substantially flush with the bottom surface 34 of the center section 28 and the first inner row of wall studs 14.

Preferably, the first and second side sections 30, 32 are secured in place with nails driven through the bottom surfaces 50, 52 of respective ones of the first and second side sections 30, 32 into the bottom surface 34 of the center section 28 and respective ones of the inner rows of wall studs 14, 16. Alternatively, wood screws may be used in the place of nails to secure the first and second side sections 30, 32. By attaching the first and second side sections 30, 32 to the center section 28 and respective ones of the inner wall studs 14, 16, the arch 10 formed thereby has a substantially uniform and continuous bottom surface which is collectively defined by the bottom surfaces 34, 50 and 52. The bottom surface of the arch 10 additionally smoothly transitions into the side surfaces of the inner wall studs 14, 16. Therefore, the arch 10 and inner wall studs 14, 16 create a uniform support surface for the application of a finish surface, as will be further explained below.

The center section 28 and the first and second side sections 30, 32 are preferably formed by the laminar juxtaposition of multiple wood laminate layers 54 fused together to form a unitary, laminated structure, as seen in FIGS. 2 and 3. The individual laminate layers 54 are typically formed around an arcuate jig structure with a glue or other binding agent being deposited between the individual laminate layers 54 so as to result in a rigid laminated structure having the desired arcuate shape. Alternatively, the center section 28 and the first and second side sections 30, 32 may be formed from bonded particulate matter including cellulose fiber, shredded paper, wooden particles, sawdust, and possible combinations thereof. A quantity of these wooden or paper particles are typically placed into a respective arcuate or circular mold along with various binding agents or other chemicals capable of resulting in a composite structure of sufficient integrity to serve the desired functions of the present invention. The center section 28, along with the first and second side sections 30, 32 may also be formed from strips of various wooden, paper, textile or other materials which are applied along with appropriate bonding agents to a respective circular mandrel to form a laminated circular member. As will be recognized, in those instances when the center section 28 and the first and second side sections 30, 32 are formed with a circular mandrel, the resulting circular product will be cut to form multiple arcuate (i.e., semicircular) products. The center section 28 and the first and second side sections 30, 32 may also be formed from a molded plastic material. Subsequent to the formation of the center section 28 and the first and second side sections 30, 32 by the previous methods, the ends thereof are cut to the proper angles, as mentioned above.

Figure 4:
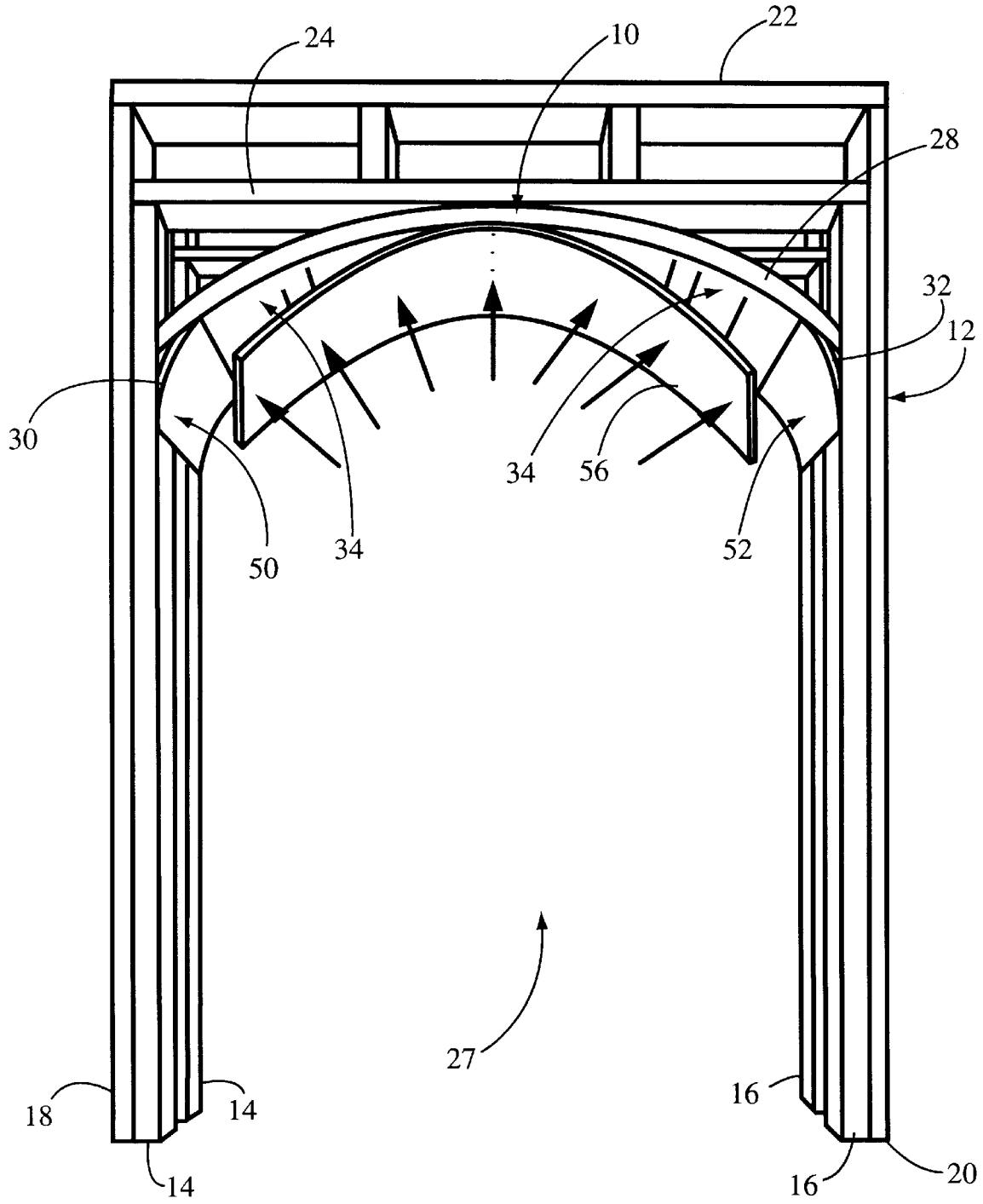
FIG. 4 perspectively illustrates the manner in which a finish surface is applied to the arch shown in FIG. 1.

In the preferred embodiment of the present invention, the dual radius arch 10 is used as a support surface for the application of a finish surface such as a sheet of drywall 56. The drywall 56 is wetted and applied to the bottom surface 34 of the center section 28 and the bottom surfaces 50, 52 of respective first and second side sections 30 and 32. The drywall 56 is first applied at the apex of the center section 28 in the direction indicated by the arrows shown in FIG. 4 and attached through the use of standard drywall screws. Next, the drywall 56 is applied along the bottom surfaces 34, 50, 52 downwardly toward the first and second rows of inner wall studs 14, 16. Because the first, second and center sections 30, 32, 28 form a uniform support surface, the drywall 56 is applied uniformly around the arch 10. Therefore, if the distance D is sufficiently large, such that a single sheet of drywall 56 cannot span the arch 10, a second and/or third sheet of drywall 56 may be abutted to the ends of the first drywall sheet 56. The drywall 56 may be additionally applied along the first and second rows of inner wall studs 14, 16 to form a uniform finish surface. Because the first and second side sections 30, 32 are flush with the respective ones of the first and second inner rows of wall studs 14, 16, the drywall 56 applied thereto will be flush around the interior of the arch 10 and along the wall studs 14, 16. In this respect, the present invention provides a building system wherein the arch 10 is easily installed with the center and side sections 28, 30, 32, and the application of a finish surface to the arch 10 is easily facilitated.

Additional modifications and improvements of the present invention may also be apparent to those of ordinary skill in the art such as the application of other finish surfaces other than drywall 56 to the arch 10. Thus, the particular combination of parts described and illustrated herein is intended to represent only a certain embodiment of the present invention, and is not intended to serve as limitations of alternative devices within the spirit and scope of the invention.

What is claimed is:

1. An arch comprising:

an arcuate center section having opposed ends and an arcuate under surface with a first radius of curvature, the arcuate center section being sized and configured such that the opposed ends thereof abut respective ones of first and second vertical wall studs; and a first and second arcuate side section attached to the center section and respective ones of the first and second vertical wall studs, the first and second side sections each having an arcuate under surface with a second radius of curvature which is less than the first radius of curvature such that the under surfaces of the first and second side sections create a continuous transition between the under surface of the arcuate center section and respective ones of the first and second vertical wall studs.

2. The arch of claim 1 wherein the ceiling structure further comprises a horizontal header extending between the first and second vertical wall studs and the arcuate center section has an arcuate upper surface abutting the horizontal header when the opposed ends thereof abut respective ones of the vertical wall studs.

3. The arch of claim 2 wherein the first radius of curvature is approximately equal to the length of the horizontal header.

4. The arch of claim 1 wherein the second radius of curvature is in the range of from about six inches to twelve inches.

5. The arch of the claim 1 wherein the center section is formed from a plurality of laminated wooden members.

6. The arch of claim 1 wherein the first and second side sections are formed from a plurality of laminated wooden members.

7. The arch of claim 1 wherein the center section is formed from bonded particulate matter selected from the group consisting of:

cellulose fiber;

shredded fiber;

wooden particles;

saw dust; and possible combinations thereof.

8. The arch of claim 1 wherein the first and second side sections are formed from bonded particulate matter selected from the group consisting of:

cellulose fiber;

shredded fiber;

wooden particles;

saw dust; and possible combinations thereof.

9. The arch of claim 1 wherein the center section is formed from a plastic material.

10. The arch of claim 1 wherein the first and second side sections are formed from a plastic material.

11. The arch of claim 1 wherein the center section and the first and second side sections are formed from a plurality of laminated wooden members.

12. The arch of claim 1 wherein the center section and the first and second side sections are formed from bonded particulate matter selected from the group consisting of:

cellulose fiber;

shredded paper;

wooden particles;

saw dust; and possible combinations thereof.

13. The arch of claim 1 wherein the center section and the first and second side sections are formed from a plastic material.

14. The arch of claim 1 wherein the under surface of the center section and the under surfaces of the first and second side sections collectively define an arcuate support surface to which a layer of finishing material may be applied.

15. The arch of claim 1 wherein the finishing material is drywall.

16. An arch comprising:

an arcuate center section having opposed ends and an arcuate under surface with a first radius of curvature, the arcuate center section being sized and configured such that the opposed ends thereof abut respective ones of first and second pairs of vertical wall studs; and a first and second arcuate side section attached to the center section and respective ones of the first and second pairs of vertical wall studs, the first and second side sections each having a radius of curvature which is less than the first radius of curvature such that the under surfaces of the first and second side sections create a continuous transition between the under surface of the arcuate center section and respective ones of the first and second vertical wall studs.

17. The arch of claim 16 wherein the ceiling structure further comprises a pair of horizontal headers extending between the first and second pairs of vertical wall studs and the arcuate center section further includes an arcuate upper surface abutting the pair of horizontal headers when the opposed ends of the center section abut respective ones of the pair of first and second vertical wall studs.

18. The arch of claim 17 wherein the first radius of curvature is approximately equal to the length of the horizontal headers and the second radius of curvature is in the range from between about six inches to twelve inches.

19. The arch of claim 16 wherein the center section and the first and second side sections are formed from a plurality of laminated wooden members.

20. The arch of claim 16 wherein the center section and the first and second side sections are formed from bonded particulate matter selected from the group consisting of:

cellulose fiber;

shredded paper;

wooden particles;

saw dust; and possible combinations thereof.

21. The arch of claim 16 wherein the center section and the first and second side sections are formed from a plastic material.

22. The arch of claim 16 wherein the under surface of the center section and the under surfaces of the first and second side sections collectively define an arcuate support surface to which a layer of finishing material may be applied.

* * * * *